US009746248B2

(12) United States Patent
Semenov et al.

(10) Patent No.: US 9,746,248 B2
(45) Date of Patent: Aug. 29, 2017

(54) HEAT PIPE HAVING A WICK WITH A HYBRID PROFILE

(71) Applicant: Thermal Corp., Wilmington, DE (US)

(72) Inventors: Sergey Y. Semenov, Lancaster, PA (US); John Gilbert Thayer, Lancaster, PA (US); Nelson J. Gernert, Elizabethtown, PA (US)

(73) Assignee: Thermal Corp., Wilmington, DE (US)

( * ) Notice: Subject to any disclaimer, the term of this patent is extended or adjusted under 35 U.S.C. 154(b) by 480 days.

(21) Appl. No.: 13/654,852

(22) Filed: Oct. 18, 2012

(65) Prior Publication Data

US 2013/0092354 A1 Apr. 18, 2013

Related U.S. Application Data

(60) Provisional application No. 61/548,262, filed on Oct. 18, 2011.

(51) Int. Cl.
*F28D 15/04* (2006.01)
*F28F 1/24* (2006.01)

(52) U.S. Cl.
CPC ..... *F28D 15/04* (2013.01); *F28F 1/24* (2013.01); *F28D 15/046* (2013.01)

(58) Field of Classification Search
CPC ..... F28D 15/046; F28D 15/04
USPC ..... 165/104.26, 146, 272
See application file for complete search history.

(56) References Cited

U.S. PATENT DOCUMENTS 3,924,674 A * 12/1975 Basiulis ..... F28D 15/0266 165/104.14
4,058,160 A * 11/1977 Corman et al. ..... 165/104.26
4,099,556 A * 7/1978 Roberts, Jr. ..... F28D 15/0241 126/635
4,393,633 A 7/1983 Charniga
4,565,243 A 1/1986 Ernst et al.
4,674,565 A * 6/1987 Beam ..... 165/104.26
5,924,482 A * 7/1999 Edwards et al. ..... 165/104.33
6,133,631 A 10/2000 Belady
6,446,706 B1 9/2002 Rosenfeld et al.
6,510,053 B1 1/2003 Azar
6,533,029 B1 3/2003 Phillips
6,704,200 B2 3/2004 Zeighami et al.
6,915,843 B2 7/2005 Kroliczek et al.
(Continued)

OTHER PUBLICATIONS

Dunn, P. D. et al., "Heat Pipes", book, (1982), 3 pages, third edition, Pergamon Press Ltd.

*Primary Examiner* — Justin Jonaitis
*Assistant Examiner* — Joel Attey
(74) *Attorney, Agent, or Firm* — Michael Best & Friedrich LLP

(57) ABSTRACT

A heat pipe system for conducting thermal energy. The heat pipe system includes a sealed tube having along its length a reservoir region, an evaporator region, and a condenser region, the tube having a first end and a second end and an inside wall. The system also includes a wick disposed adjacent the inside wall of the tube, the wick including a first portion at the first end of the tube and a second portion adjacent the first portion, wherein the first portion of the wick is thicker than the second portion of the wick, and wherein the second portion of the wick does not extend to the second end of the tube. The system also includes a working fluid contained within the tube.

21 Claims, 2 Drawing Sheets

(56) References Cited

U.S. PATENT DOCUMENTS

| | | | | |
|---|---|---|---|---|
| 6,926,072 | B2 | 8/2005 | Wert | |
| 6,971,443 | B2 * | 12/2005 | Kung et al. | 165/104.26 |
| 6,972,365 | B2 | 12/2005 | Garner | |
| 7,111,394 | B2 | 9/2006 | Wert | |
| 7,120,022 | B2 | 10/2006 | Belady et al. | |
| 7,124,810 | B2 | 10/2006 | Lee et al. | |
| 7,137,441 | B2 | 11/2006 | Hsu | |
| 7,149,086 | B2 | 12/2006 | Faneuf et al. | |
| 8,590,601 | B2 * | 11/2013 | Lee | 165/104.26 |
| 2002/0074108 | A1 | 6/2002 | Khrustalev et al. | |
| 2007/0084587 | A1 | 4/2007 | Huang et al. | |
| 2007/0204974 | A1 | 9/2007 | Gupta et al. | |
| 2007/0240858 | A1 | 10/2007 | Hou et al. | |
| 2007/0295485 | A1 | 12/2007 | Liu et al. | |
| 2008/0068793 | A1 | 3/2008 | Ishimine | |
| 2008/0212282 | A1 | 9/2008 | Hall et al. | |
| 2009/0025910 | A1 * | 1/2009 | Hoffman et al. | 165/104.26 |

* cited by examiner

HEAT PIPE HAVING A WICK WITH A HYBRID PROFILE

CROSS-REFERENCE TO RELATED APPLICATIONS

This application claims priority to U.S. Provisional Patent Application No. 61/548,262 filed Oct. 18, 2011, the content of which is incorporated herein by reference in its entirety.

BACKGROUND

Heat pipes are passive devices used to draw heat from one location and dissipate the heat at a different location, and can take a number of different shapes and forms, including thermosyphons. Heat pipes may be used in a variety of applications, including, for example, drawing heat from electronics components. Heat pipes contain a working fluid and typically a wick on the inside wall of the pipe. In some applications, however, excess fluid may build up in certain areas of the heat pipe and form pools that are not absorbed by the wick. If the heat pipe is subjected to extreme conditions such as subfreezing temperatures, this excess working fluid (e.g. water) may undergo cycles of freezing and thawing that can damage the wick and/or the heat pipe itself.

SUMMARY

Current heat pipes typically operate with an oversupply of working fluid, leaving them with pooled liquid when idle, and thus are susceptible to freeze/thaw damage. Heat pipes that not oversupplied with working fluid typically have a uniform layer of wick, resulting in a uniformly thicker wick throughout the heat pipe with a higher $\Delta T_{wick}$. Some heat pipes have distinct wick regions for reservoirs and heat input zones. However, in many cases, the condensate does not inherently flow over the heat input zone. Instead, replenishment of the wick in the heat input zone depends on capillary action to draw liquid from a reservoir, leaving it more susceptible to dry-out, which is generally an undesirable condition in such cases. In cases where there is a very large ratio of condenser area to heat input area (as in a space radiator), or where gravity is less strong to pull condensate back to the evaporator (e.g., in space or on the moon), addressing the simultaneous challenges of freeze/thaw and low $\Delta T_{wick}$ is particularly difficult. The hybrid wick according to various embodiments of the present invention is particularly advantageous for such applications.

Accordingly, some embodiments of the invention provide a heat pipe with a hybrid wick which is thicker at one end of the heat pipe (in a reservoir region) so as to hold all or substantially all of the fluid in the condensed state when the pipe is idle. The hybrid wick can also include a thin portion adjacent to the thick portion, wherein the thin portion corresponds to an evaporator region of the heat pipe to which a first heat source is applied. The opposing end of the heat pipe, corresponding to a condenser portion in which fluid condenses to dissipate heat absorbed in the evaporator region, does not have any wick material. In some embodiments, the reservoir region has a second heat source applied to it to promote drying of the thicker portion of the wick in operation of the heat pipe.

In some embodiments, the present invention provides a heat pipe system for conducting thermal energy. The heat pipe system includes a sealed tube having along its length a reservoir region, an evaporator region, and a condenser region, the tube having a first end and a second end and an inside wall. The system also includes a wick disposed adjacent the inside wall of the tube, the wick including a first portion at the first end of the tube and a second portion adjacent the first portion, wherein the first portion of the wick is thicker than the second portion of the wick, and wherein the second portion of the wick does not extend to the second end of the tube. The system also includes a working fluid contained within the tube.

Some embodiments of the present invention provide a heat pipe system for conducting thermal energy. The heat pipe system includes a sealed tube having along its length a reservoir region, an evaporator region, and a condenser region, the tube having a first end, a second end, and an inside wall extending between the first and second ends. The heat pipe system also includes a wick disposed adjacent the inside wall of the tube, the wick including a first portion at the first end of the tube and a second portion adjacent the first portion and thinner than the first portion; and a quantity of working fluid contained within the tube. The heat pipe system has a first state in which the wick holds substantially the entire quantity of working fluid, and a second state in which heat is supplied to the evaporator region, in which the wick holds a portion of the quantity of working fluid, and in which a first part of a remainder of the working fluid has been heated to a vapor form, and in which a second part of the remainder of the working fluid is in condensed form on the inside wall of the tube in the condenser region of the tube.

In some embodiments, a method of cooling using a heat pipe is provided. The method includes steps of heating a sealed tube at an evaporator region of the sealed tube located along the sealed tube between a condenser region and a reservoir region; evaporating a working fluid in a first wick lining the evaporator portion of the sealed tube; condensing the evaporated working fluid in the condenser region of the sealed tube; moving the condensed working fluid back toward the evaporator portion of the sealed tube; repeating the heating, evaporating, condensing, and moving steps with the condensed working fluid; and maintaining a second wick lining the reservoir region of the sealed tube in a substantially dry condition during the heating, evaporating, condensing, and moving steps, wherein the second wick lining the reservoir region is thicker than the first wick lining the evaporator region.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
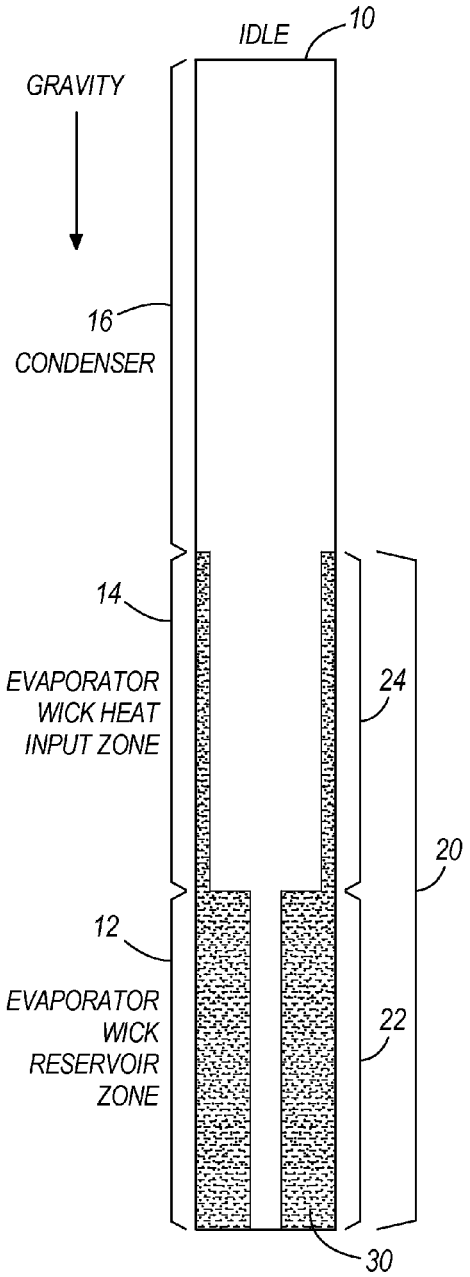
FIG. 1A shows a heat pipe having a hybrid wick where the heat pipe is idle, i.e. with no heat applied to the evaporator region of the heat pipe.

In various embodiments, the invention provides a heat pipe 10 with a hybrid wick 20 disposed therein. The heat pipe 10 is generally a sealed tube having along its length a reservoir region 12, an evaporator region 14, and a condenser region 16 (FIG. 1A). In some embodiments, the heat pipe 10 is made of copper tubing and can be various diameters, ranging from about 0.25 inch to about 0.625 inch, and anywhere from about 3 to about 18 inches in length, although other materials, diameters, and lengths are also possible and are encompassed within the present invention. Furthermore, other pipe cross-sectional shapes (e.g. oval, polygonal, and the like) are also possible. Finally, the heat pipes 10 may be straight or may have one or more bends along their lengths as appropriate for the given application.

The hybrid wick 20 can be made of various materials, and in some embodiments is made of sintered copper powder. In certain embodiments, the condenser region 16 has a heat sink attached thereto, for example one or more conductive fins attached to the condenser region 16 in a thermally conductive manner.

The hybrid wick 20 of the illustrated embodiment is disposed adjacent to and in thermal contact with the inside wall of the heat pipe 10 (FIG. 1A). Also, the illustrated hybrid wick 20 has a thick portion 22 which corresponds to the reservoir region 12 of the heat pipe 10, and a thin portion 24 which is thinner than and adjacent to (and generally in capillary contact with) the thick portion 22 of the hybrid wick 20, and corresponds to the evaporator region 14 of the heat pipe 10.

The heat pipe 10 contains a working fluid 30 which is selected so that its evaporation and condensation temperatures are appropriate for the operating temperature range of the particular application. Possible working fluids 30 include water, ammonia, acetone, or methanol. Generally only a small volume of working fluid 30 is added to the heat pipe 10 (e.g. a fraction of a percent of the total volume of the interior of the heat pipe 10), and the remaining volume of the heat pipe 10 may be filled with a gas or, more typically, is evacuated so that the interior of the heat pipe 10 contains only the working fluid 30 in either a liquid or vapor form. The interior pressure of the heat pipe 10 may be adjusted when evacuating or adding gas to further adjust the working temperature range of the heat pipe 10.

The volume of working fluid 30 in the heat pipe 10 is adjusted so that when the heat pipe 10 is idle, i.e. when no heat source is applied to the evaporator region 14 under normal or intended operating conditions of the heat pipe, all of the working fluid 30 is absorbed to the hybrid wick 20, and there is no excess fluid pooled in the heat pipe 10 (FIG. 1A). Accordingly, if the idle heat pipe 10 with hybrid wick 20 is exposed to low temperatures (e.g. a temperature below the freezing point of the working fluid 30 under the conditions present in the heat pipe 10), the working fluid 30 will be contained within the hybrid wick 20 and thus will be less susceptible to freezing. When the heat pipe 10 is active, i.e. when a heat source is applied to the evaporator region 14, the working fluid 30 in the thin portion 24 of the hybrid wick 20 evaporates, and some or all of the vapor travels to the condenser region 16. In the condenser region 16, the evaporated working fluid 30 condenses and forms a film 32 on the inside wall of the heat pipe 10. Also, after sufficient time in operation, and based upon the selected quantity of working fluid in the heat pipe as described above, working fluid originally in the wick of the reservoir region 12 is drawn up to the evaporator region 14 where it enters the cycle of evaporation and condensation in the evaporator and condenser regions 14, 16 (rather than being returned to the reservoir region 12). In this manner, the reservoir region 12 dries out, with all or substantially all of the working fluid being utilized in the cooling process of the heat pipe 10.

Figure 1B:
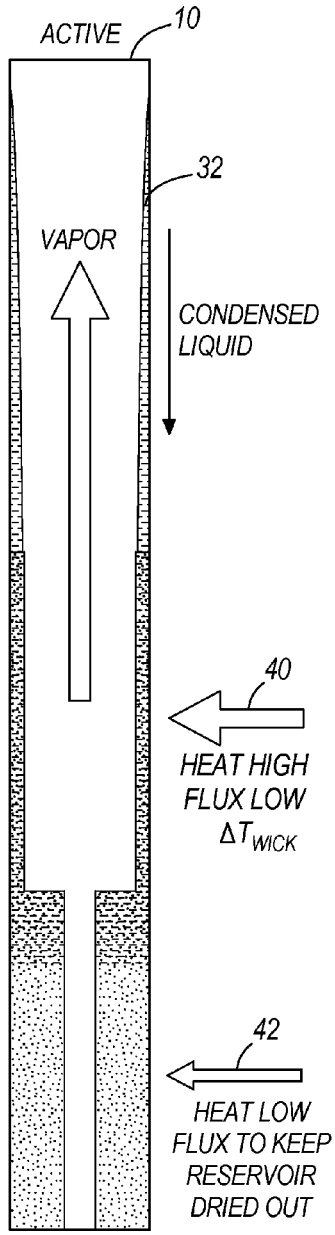
FIG. 1B shows a shows a heat pipe having a hybrid wick where the heat pipe is active, i.e. with heat being applied to the evaporator region of the heat pipe.

In some applications, the heat pipe 10 with hybrid wick 20 generally is operated in a vertical orientation relative to gravity, i.e. with the condenser region 16 at the top and the reservoir region 12 at the bottom (FIGS. 1A, 1B). When oriented vertically, the film 32 of working fluid 30 on the inside wall in the condenser region 16 of the heat pipe 10 will move by the force of gravity towards the evaporator region 14, thereby keeping the thin portion 24 of the hybrid wick 20 wetted with working fluid 30 and thereby re-supplying the thin portion 24 with working fluid 30 to promote steady-state heat transfer (FIG. 1B).

When the heat pipe 10 is used in an environment with low or zero gravity (e.g. in a spacecraft), the flow of working fluid 30 would be similar to what is described above, although the rate of flow of working fluid 30 from the wickless condenser region 16 to the thin portion 14 of the hybrid wick 10 might be slower in the absence of gravity or with reduced gravitational force compared to the rate of flow in the presence of Earth's gravity. For example, the working fluid 30 which condenses on the inside wall of the heat pipe 10 in the condenser region 16 would still form a film 32 in a low- or zero-gravity environment, and the film 32 would spread more or less evenly along the surface of the inside wall of the condenser region 16 of the heat pipe 10. Thus, the film 32 as it spreads would eventually come into contact with the thin portion 24 of the hybrid wick 20, at which point the working fluid 30 would be drawn by capillary action into the thin portion 24 of the hybrid wick 20.

The thin portion 24 of the hybrid wick 20 is designed to be thin enough such that, in the presence of a high heat flux, there will be a low $\Delta T_{wick}$. In various embodiments, the thin portion 24 of the hybrid wick 20 is sufficiently thin to permit the working fluid 30 to evaporate more rapidly without building up a steep heat gradient, thereby permitting rapid dissipation of the incoming heat flux.

Figure 2:
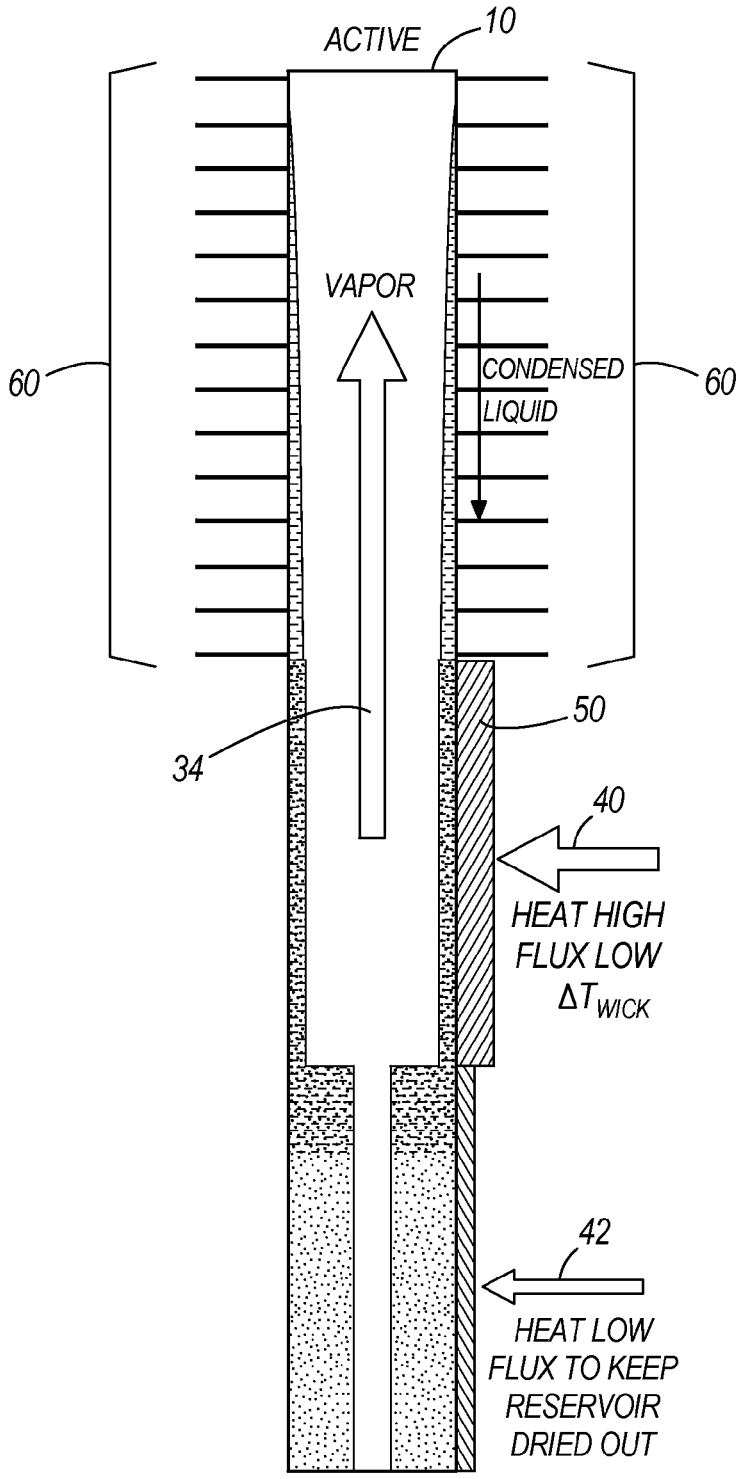
FIG. 2 shows a heat pipe having a hybrid wick where the heat pipe is active and is shown with a first heat source thermally coupled to the reservoir region, a second heat source thermally coupled to the evaporator region, and a heat sink coupled to the condenser region.

In use, the evaporator region 14 of the heat pipe 10 is placed in thermal contact with a first heat source 40, for example an electronics component 50 such as a microprocessor (FIG. 2) to be cooled. The working fluid 30 is evaporated, and vapor 34 moves to the condenser region 16, which can be in thermal contact with a heat sink (for example, one or more heat-dissipating fins 60, as shown in FIG. 2. The vapor 34 then condenses on the inside surface of the heat pipe 10 in the condenser region 16 to form the film 32. Optionally, the reservoir region 12 is placed in thermal contact with a second heat source 42 to promote drying of the reservoir region 12, which in turn puts more of the working fluid 30 in the evaporator region 14 and the condenser region 16 to promote movement of thermal energy. The second heat source 42 may be generated by diverting a fraction of the heat from the evaporator region 14 to the reservoir region 12. By drying the thick portion 22 of the hybrid wick 10, this forces most of the working fluid 30 out of the reservoir region 12 of the heat pipe 10 so that the working fluid 30 can cycle between the evaporator region 14 and the condenser region 16 to remove heat from the evaporator region 14.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A heat pipe system for conducting thermal energy, comprising:

a sealed tube having along its length a reservoir region, an evaporator region, and a condenser region, the tube having a first end, a second end, and an inside wall;

a wick structure disposed adjacent the inside wall of the tube, the wick structure comprising a first portion corresponding to the reservoir region of the tube, and a second portion adjacent the first portion, the second portion of the wick structure corresponding to the evaporator region of the tube, wherein the first portion of the wick structure is thicker than the second portion of the wick structure, and wherein the second portion of the wick structure does not extend to the second end of the tube, such that a portion of the tube between the first and second ends does not include a wick structure; and a working fluid contained within the tube, wherein the volume of working fluid in the tube is such that (i) when heat is applied to the evaporator region, working fluid in the first portion of the wick structure is drawn up to the second portion of the wick structure to completely dry out the first portion of the wick structure and (ii) when no heat is applied to the wick structure all of the working fluid is absorbed by the wick structure.

2. The heat pipe system of claim 1, further comprising a first heat source adjacent the evaporator region.

3. The heat pipe system of claim 2, further comprising a second heat source adjacent the reservoir region.

4. The heat pipe system of claim 3, further comprising a heat sink in contact with the condenser region.

5. The heat pipe system of claim 4, wherein the working fluid comprises water.

6. The heat pipe system of claim 1, wherein the second portion of the wick structure is continuous with the first portion of the wick structure.

7. A heat pipe system for conducting thermal energy, comprising:

a sealed tube having along its length a reservoir region, an evaporator region, and a condenser region, the tube having a first end, a second end, and an inside wall extending between the first and second ends;

a wick structure disposed adjacent the inside wall of the tube, the wick structure comprising a first portion corresponding to the reservoir region of the tube, and a second portion adjacent the first portion and thinner than the first portion, the second portion of the wick structure corresponding to the evaporator region of the tube, wherein the second portion of the wick structure does not extend to the second end of the tube, such that a portion of the tube between the first and second ends does not include a wick structure; and a quantity of working fluid contained within the tube, the heat pipe system having a first state in which all of the working fluid is held as a liquid within the wick structure and no heat is applied to the evaporator region, and a second state in which heat is supplied to the evaporator region, and a first part of the working fluid has been heated to a vapor form and a second part of the working fluid is in condensed form on the inside wall of the tube in the condenser region of the tube, wherein the volume of working fluid in the tube is such that in the second state working fluid in the first portion of the wick structure is drawn up to the second portion of the wick structure to completely dry out the first portion of the wick structure.

8. The heat pipe system of claim 7, further comprising a first heat source adjacent the evaporator region.

9. The heat pipe system of claim 8, further comprising a second heat source adjacent the reservoir region.

10. The heat pipe system of claim 9, further comprising a heat sink in contact with the condenser region.

11. The heat pipe system of claim 10, wherein the working fluid comprises water.

12. The heat pipe system of claim 7, wherein the second portion of the wick structure is continuous with the first portion of the wick structure.

13. A heat pipe system for conducting thermal energy, comprising:

a sealed tube having along its length a reservoir region, an evaporator region, and a condenser region, the tube having a first end, a second end, and an inside wall;

a wick structure disposed adjacent the inside wall of the tube, the wick comprising a first portion and a second portion corresponding to the evaporator region and adjacent the first portion, the first portion corresponding to the reservoir region, wherein the first portion of the wick structure is thicker than the second portion of the wick structure, and wherein the second portion of the wick structure does not extend to the second end of the tube, such that a portion of the tube between the first and second ends does not include a wick structure;

a working fluid contained within the tube;

a first heat source adjacent the evaporator region; and a second heat source adjacent the reservoir region, wherein the volume of working fluid in the tube is such that thermal flux applied by the second heat source to the reservoir region promotes drying of the first portion of the wick structure.

14. The heat pipe system of claim 13, wherein the second heat source has a lower heat flux than the first heat source.

15. The heat pipe system of claim 13, wherein the second portion of the wick structure is continuous with the first portion of the wick structure.

16. A heat pipe system for conducting thermal energy from a heat source, comprising:

a sealed vessel having a reservoir region, an evaporator region, and a condenser region;

a wick structure disposed inside the sealed vessel, the wick structure comprising a first portion corresponding to the reservoir region, and a second portion thinner than the first portion and corresponding to the evaporator region, wherein the heat source is applied adjacent to the evaporator region of the sealed vessel and the second portion of the wick structure is positioned closer to the heat source than is the first portion of the wick structure, and wherein the condenser region has no wick structure; and a quantity of working fluid contained within the sealed vessel, the heat pipe system having a first state in which all of the working fluid is held as a liquid within the wick structure and no heat is applied to the evaporator region, and a second state in which heat is applied to the evaporator region, and a first part of the working fluid in the second portion of the wick structure has been heated to evaporate and form a vapor and a second part of the working fluid is in condensed form on an inside wall of the vessel in the condenser region, wherein the volume of working fluid in the vessel is such that in the second state working fluid in the first portion of the wick structure is drawn to the second portion of the wick structure to completely dry out the first portion of the wick structure.

17. The heat pipe system of claim 16, further comprising a condenser, wherein the condenser region is an inside surface of the condenser.

18. A heat pipe system for conducting thermal energy, comprising:

a sealed vessel having a reservoir region, an evaporator region, and a condenser region;

a wick structure comprising a first portion corresponding to the reservoir region of the vessel and a second portion adjacent the first portion, the second portion of the wick structure corresponding to the evaporator region of the vessel, wherein when a heat flux is applied to both the first portion and the second portion of the wick structure, the first portion of the wick structure has a greater temperature differential across the first portion of the wick structure than across the second portion of the wick structure, and wherein the second portion of the wick structure does not extend into the condenser region, such that the condenser region does not include a wick structure; and a working fluid contained within the sealed vessel, wherein the volume of working fluid in the sealed vessel is such that (i) when heat is applied to the evaporator region, working fluid in the first portion of the wick structure is drawn to the second portion of the wick structure to completely dry out the first portion of the wick structure and (ii) when no heat is applied to the wick structure all of the working fluid is absorbed by the wick structure.

19. The heat pipe system of claim 18, further comprising a condenser, wherein the condenser region is an inside surface of the condenser.

20. A heat pipe system for conducting thermal energy, comprising:

a sealed vessel having a reservoir region, an evaporator region, and a condenser region;

a wick structure disposed adjacent an inside wall of the vessel, the wick structure comprising a first portion corresponding to the reservoir region of the tube, and a second portion adjacent the first portion, the second portion of the wick structure corresponding to the evaporator region of the tube, wherein the first portion of the wick structure is thicker than the second portion of the wick structure, wherein the condenser portion does not include a wick structure; and a working fluid contained within the tube, wherein the volume of working fluid in the vessel is such that (i) when heat is applied to the evaporator region, working fluid in the first portion of the wick structure is drawn up to the second portion of the wick structure to completely dry out the first portion of the wick structure and (ii) when no heat is applied to the wick structure all of the working fluid is absorbed by the wick structure.

21. The heat pipe system of claim 20, further comprising a condenser, wherein the condenser region is an inside surface of the condenser.

* * * * *